US005163365A

United States Patent [19]

Taylor

[11] Patent Number: 5,163,365

[45] Date of Patent: Nov. 17, 1992

[54] CALENDER SYSTEM FOR DECOUPLING SHEET FINISH AND CALIPER CONTROL

[75] Inventor: Bruce S. Taylor, San Jose, Calif.

[73] Assignee: Measurex Corporation, Cupertino, Calif.

[21] Appl. No.: 403,583

[22] Filed: Sep. 6, 1989

[51] Int. Cl.[5] ..... B30B 15/34; D21G 1/00

[52] U.S. Cl. ..... 100/38; 100/74; 100/93 RP; 162/206; 162/207

[58] Field of Search ..... 100/93 RP, 161, 162 R, 100/43, 47, 38, 73–75; 118/67, 68, 665; 162/204–207, 290, 359; 427/366, 382, 361, 365

[56] References Cited

U.S. PATENT DOCUMENTS

| | | | |
|---|---|---|---|
| 1,291,626 | 1/1919 | Parks | 100/38 |
| 2,291,616 | 8/1942 | Fletcher | 100/75 X |
| 4,370,923 | 2/1983 | Schmidt | 100/93 RP X |
| 4,642,164 | 2/1987 | Hanhikoski et al. | 100/93 RP X |
| 4,653,395 | 3/1987 | Verkasalo | 100/38 |
| 4,786,529 | 11/1988 | Boissevain | 100/93 RP X |

FOREIGN PATENT DOCUMENTS

| | | | |
|---|---|---|---|
| 570261 | 2/1959 | Canada | 100/74 |

*Primary Examiner*—Harvey C. Hornsby
*Assistant Examiner*—Stephen F. Gerrity
*Attorney, Agent, or Firm*—Spensley Horn Jubas & Lubitz

[57] ABSTRACT

A system for at least partly decoupling the control of sheet finish and sheet caliper in a calender stack is disclosed. The system includes a heating device for heating the sheet with dry heat substantially immediately before the sheet is pressed by an upstream nip of the calender stack and a moisturizer for moisturizing the sheet substantially immediately before the sheet is pressed at a downstream nip of the calender stack. The sheet is moisturized without substantially altering the sheet temperature.

24 Claims, 5 Drawing Sheets

CALENDER SYSTEM FOR DECOUPLING SHEET FINISH AND CALIPER CONTROL

BACKGROUND OF THE INVENTION

1. Field of the Invention

The present invention relates to the field of sheet processing, and more particularly to the field of calendering a paper sheet to achieve a desired sheet finish and caliper.

2. Description of the Related Art

One of the aspects by which sheet materials are graded is the "finish" of the sheet surface. For example, paper may be categorized into various grades having different degrees of smoothness or gloss for various applications. Sheet smoothness and gloss are collectively known as sheet "finish." Although smoothness and gloss are important characteristics of most papers, the term "smoothness" is most often used in connection with uncoated paper sheet, while the term "gloss" usually refers to the shininess of coated paper sheet, such as that often used in magazines.

Bulk paper is frequently produced in a continuous sheet which may be wound in a roll. The paper roll may have a dimension in the cross-direction (i.e., across the width of the sheet) of 25 feet or more. The continuous sheet may then be unrolled and cut into individual sheets of the desired size. The consistency of the surface finish between the individual sheets depends upon the uniformity of the finish of the original bulk paper roll. Thus, it is important to have a uniform finish across the width and along the length of the continuous bulk paper roll.

Another characteristic by which sheet materials are graded is sheet thickness or "caliper." Bulk paper production typically involves a calendering process which includes pressing the paper sheet material between a plurality of calender rolls to obtain the desired sheet characteristics. For example, subjecting a paper sheet to the calendering process can change its caliper as well as its finish. Sheet finish, including gloss and smoothness, may be conventionally controlled by applying steam to the surface of the paper sheet, followed by pressing the sheet between a series of calender rolls. Typically, the series of calender rolls is arranged in a stack, which may consist of alternating hard, polished steel rolls and soft, resilient rolls made of cotton or polymers. A typical series of such hard and soft rolls is known as a "supercalender".

The paper absorbs the heat and moisture of the steam, and paper fibers at the sheet surface are softened. As the polished steel roll comes into contact with the paper surface that has been treated with steam, the paper surface is smoothed and pressed flat by the pressing and rubbing action of the hard steel roll against an adjacent soft roll, thereby producing a smooth or glossy finish on the surface of the paper. This process is similar to treating a laundered shirt with a steam iron and ironing board to removing wrinkles from the cloth. The degree of smoothness, or gloss, is dependent upon the amount of heat, moisture and pressure applied to the sheet.

Unfortunately, a problem commonly associated with the use of steam treatments to create a desired finish is that the steam treatment used to affect the finish also produces a concurrent effect on the caliper profile of the paper. Specifically, the heat and moisture of the steam may penetrate the paper sheet and soften both its surface and core fibers. Subsequent action by the calender rolls, while smoothing the softened surface fibers and creating the desired finish, also simultaneously decreases the caliper of the sheet because the core fibers are also unintentionally softened. An increase in the smoothness or gloss of the paper surface may thus be "coupled" to a substantial decrease in sheet caliper. However, the desired caliper and surface finish could be obtained with greater predictability and precision if the two characteristics could be partially or completely "decoupled", (i.e., controlled independently).

A related problem associated with systems that regulate the amount of steam applied to different sections of the surface of the paper sheet lies in the fact that steam is used. Upon contact with the sheet, the condensing steam liberates a substantial amount of heat energy to the sheet. However, for saturated steam, the relationship between moisture and heat is fixed. That is, for a given volume and flow of steam applied to a sheet surface, there will be a fixed amount of available heat and water in the steam. Therefore, with steam, the amount of moisture, which primarily effects finish, is directly proportional to the amount of heat, which affects both the finish and sheet caliper. Thus, a paper mill operator's flexibility in producing a paper sheet of a desired finish and caliper may be extremely limited using conventional steam systems.

SUMMARY OF THE INVENTION

The present invention is directed to a system for substantially independently controlling the finish and caliper of a sheet material, such as paper, by separately and independently controlling the amount of heat and moisture directed at the surface of the sheet material. With the present invention, the paper mill operator can obtain greater flexibility and achieve greater predictability and precision in the production of paper sheet having a desired finish and caliper.

The invention provides a means for increasing or decreasing the amount of penetrating dry heat applied to the paper sheet at one location in a calender stack and separately and independently varying the amount of moisture applied to the surface of the same sheet at a different location in the calender stack, to thereby obtain a desired sheet caliper while independently controlling the sheet finish. For example, the dry heat may be applied to the sheet substantially immediately before the sheet is pressed between one nip of a calender stack while moisture is applied to the sheet surface substantially immediately before the sheet is pressed between a different nip of the calender stack. To most effectively decouple sheet caliper and finish, the invention preferably provides for applying dry penetrating heat to the sheet at an upstream location (relative to the direction of sheet travel) in the calender stack just before the sheet is pressed in a nip formed between two calender rolls. Moisture is applied to the sheet surface at a downstream location in the calender stack just before the same sheet is pressed in the nip formed between other calender rolls.

The dry heat is preferably applied upstream in the calender stack where the sheet is more compressible and before it has been subjected to the substantial pressures created between adjacent calender rolls. By providing the dry heat at this location, for example, immediately before the sheet is pressed in the first nip of the calender stack, control over sheet caliper is maximized.

Conversely, moisture is preferably applied to the sheet surface as far downstream in the calender stack as practical, for example, immediately before the sheet enters the last nip. At this location, the sheet has already been compressed a substantial amount and is, therefore, subject only to a minimal additional decrease in caliper. Simultaneously, the sheet is most dense, and the surface less porous, at the downstream locations of the calender stack and, therefore, least subject to penetration by moisture. And finally, in the case of coated sheet grades, the coating is more durable and less prone to moisture induced detachments at the downstream end of the calender stack. By applying moisture at this downstream location, and immediately before a nip in the calender stack, the added moisture will be less able to penetrate to the core fibers and, therefore, will primarily soften the surface fibers of the sheet. Thus, at this downstream location, the affect of adding moisture to the sheet is primarily upon surface finish.

Applying moisture to the sheet downstream from the application of dry heat increases the efficiency of caliper control and further helps to decouple the control of caliper and finish. The efficiency of caliper control is increased because less heat energy is required to increase the temperature of a dry sheet than to increase, by the same amount, the temperature of a moist sheet. Caliper and finish are more efficiently decoupled when the sheet is moisturized downstream of the dry heating for a related reason. That is, if the sheet is moisturized first, then the sheet temperature rise will depend, not only upon how much dry heat energy is directed at the sheet, but also upon whether and how much water is added to the sheet to affect finish. Thus, it is usually preferable to apply moisture to the sheet at a nip downstream from the nip where dry heat is applied to the sheet.

The system of the present invention may comprise two separate housings, of which multiple units of each may be used, located adjacent the sheet material. The first housing(s) includes a means for directing variable amounts of dry, penetrating heat at the sheet. For example, an infrared lamp or device for directing hot air at the sheet may be used. The second housing includes means for independently applying variable amounts of moisture to the sheet surface. For example, a device for directing a water mist at the sheet may be used. The heat and moisture are applied to the sheet at separate nips on the supercalender before the sheet material is pressed between a steel roll and an adjacent soft roll, to thereby create the desired finish (typically on the side of the paper which comes into contact with the steel roll), while simultaneously and independently controlling sheet caliper.

On conventional hard-nip calender stacks, comprising a series of adjacent hard steel calender rolls, sectionalized external roll heating and/or cooling devices are used to thermally increase and decrease the local diameter of adjacent rolls across their width. This controllable thermal increase and decrease in the roll diameters, decreases and increases, respectively, the caliper of the sheet calendered therebetween. However, this practice is not effective on supercalenders where the soft roll conforms too easily to variations in the mating steel roll diameters. Therefore, to produce the desired caliper on a supercalendered sheet, the present invention relies upon changes in compressibility of core sheet fibers produced by varying the sheet temperature, rather than varying the temperature and related diameter of the adjacent calender rolls.

To create and maintain the desired sheet caliper, a conventional sheet caliper sensor may be disposed adjacent the sheet at a location downstream from the supercalender stack. This caliper sensor monitors the caliper of the sheet at each cross-directional interval or "slice" across the width of the sheet and generates signals corresponding to the sheet caliper at each slice. Signals from such a caliper sensor are provided to a controller which is designed to independently adjust the amount of heat applied to the sheet at each slice to achieve the desired caliper. The controller applies more heat to decrease the sheet caliper and less heat if the measured sheet caliper is too low.

Similarly, the finish profile is monitored with a conventional finish sensor (such as a gloss or smoothness sensor), also disposed at a location adjacent the sheet and downstream of the supercalender stack. This sensor monitors the degree of gloss or smoothness of the surface of the sheet material at each slice in the cross-direction of the sheet and generates signals corresponding to the gloss or smoothness of each slice. The signals from the finish sensor are then also provided to a controller which increases and decreases the amount of moisture applied to the sheet surface at each slice to achieve the desired finish.

As previously mentioned, both heat and moisture affect sheet finish. However, heat alone is frequently insufficient to achieve the desired finish. Therefore, in many sheet manufacturing situations, the finish controller can be designed to increase and decrease moisture application to achieve the desired finish independently of the amount of heat used to affect caliper.

DETAILED DESCRIPTION OF THE DRAWINGS

The following description is of the best presently contemplated mode of carrying out the invention. This description is made for the purpose of illustrating the general principles of the invention and should not be taken in a limiting sense. The scope of the invention is best determined by reference to the appended claims.

Figure 1:
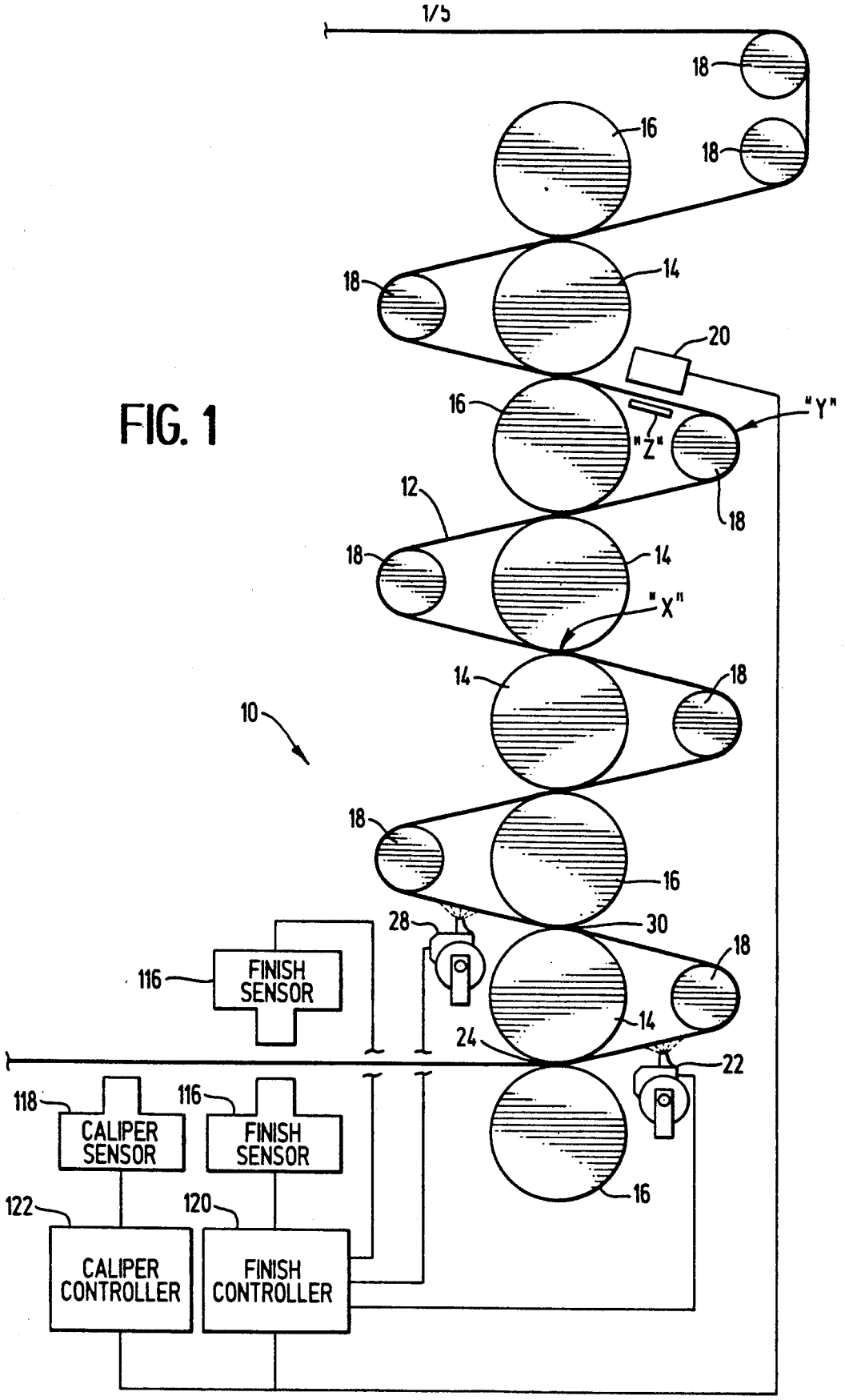
FIG. 1 is a side plan view illustrating a supercalender stack used in the production of paper sheet and a preferred placement of the sheet heating and moisturizing devices.

FIG. 1 is a schematic illustration of a process in which the present invention may be applied. This figure shows a system of calender rolls 10 suitable for pressing a sheet material 12, such as paper. For the purpose of this discussion, the sheet material 12 will be understood to be paper. However, the present invention is not necessarily limited solely to use with paper.

Alternating calender rolls 16 have a highly polished hard surface, typically made of steel. Positioned adjacent to the steel rolls 16 are rolls 14 having a somewhat resilient surface, and which are typically made of cotton. The alternating hard steel rolls 16 and the "soft" rolls 14 are arranged in a vertical stack, called a "supercalender". The sheet material 12 passes between the rolls 14, 16 in a path having a general "S"-shaped configuration. Fly or lead rolls 18 are provided on the sides of the supercalender stack 10 to facilitate the movement of the sheet 12 through the stack 10. The stack may include a reversing nip "x" formed by two adjacent hard or soft rolls, intended to reverse the side of the sheet which is finished against the steel rolls.

FIG. 1 depicts an arrangement of an embodiment of the invention, wherein the sheet heating device 20 is placed near the top of the calender stack 10 (i.e., near the location where the paper sheet 12 first enters the calender stack 10) and the water mist device 22 is placed immediately before the paper 12 enters the last nip 24 of the calender stack 10. Dry heat, applied to one side of the sheet 12 by the heating device 20 penetrates the sheet 12 to soften both the surface and core fibers. The sheet heating device 20 may be positioned immediately before the sheet enters the first nip of the calender stack 10. Preferably, however, the heating device 20 is located so as to apply heat to that side of the sheet 12 which is finished against a "soft" roll 14, in order to minimize the effect of heat on finish which is more effectively produced by the hard steel roll. Also, the heating surface of the heating device 20 is preferably positioned above the sheet to avoid a fire in the event the sheet breaks and comes to rest on the heating device 20.

After heating, the sheet 12 is compressed by the action of the calender rolls 14, 16. This pressing action produces a decrease in sheet caliper which is related to and may be controlled by the temperature of the sheet 12. Because heated paper fibers are more pliable than unheated fibers, increasing local sheet temperature increases local sheet compressibility. Therefore, a desired sheet caliper profile along the cross-direction of the sheet 12 can be obtained by selectively heating various slices of the sheet immediately prior to pressing between adjacent calender rolls 14, 16. Usually, a uniform sheet caliper will be desired.

Heating the sheet 12, followed by subsequent pressing between the calender rolls 14, 16, will usually somewhat increase the surface finish. However, once the desired caliper profile is achieved, further heating to affect finish will simultaneously create an undesirable additional decrease in caliper. Therefore, to further improve finish while minimizing a corresponding decrease in caliper, a mist, from a water mist device 22, is controllably applied to the surface of the moving sheet 12, preferably towards the bottom of the calender stack 10, for example, immediately before the sheet 12 enters the final nip 24 of the calender stack 10. Because the sheet 12 is moving rapidly between the calender rolls 14, 16, this additional moisture will have little time to penetrate the sheet 12 and therefore will not soften the core fibers sufficiently to affect the sheet caliper. Instead, the added moisture softens primarily, if not exclusively, the surface fibers. Thus, the effect of the added moisture is limited to improving the sheet finish, without substantial further decrease in sheet caliper. Furthermore, control of the finish is achieved by controlling the mist device 22 to selectively apply controlled amounts of moisture to each slice of the sheet 12, to thereby affect the profile of the sheet finish.

In supercalenders, wherein it is desired to control the finish of both sides of the sheet 12, a second water mist device 28 may also be disposed immediately before the penultimate nip 30 to direct the mist at the opposite sheet surface. This mist device 28 functions identically to the previously discussed mist device 22. However, because, as previously mentioned, the mist devices 22, 28 affect primarily surface fibers, it is necessary to provide such devices on both sides of the sheet 12 to control surface finish on both sheet surfaces.

Figure 2:
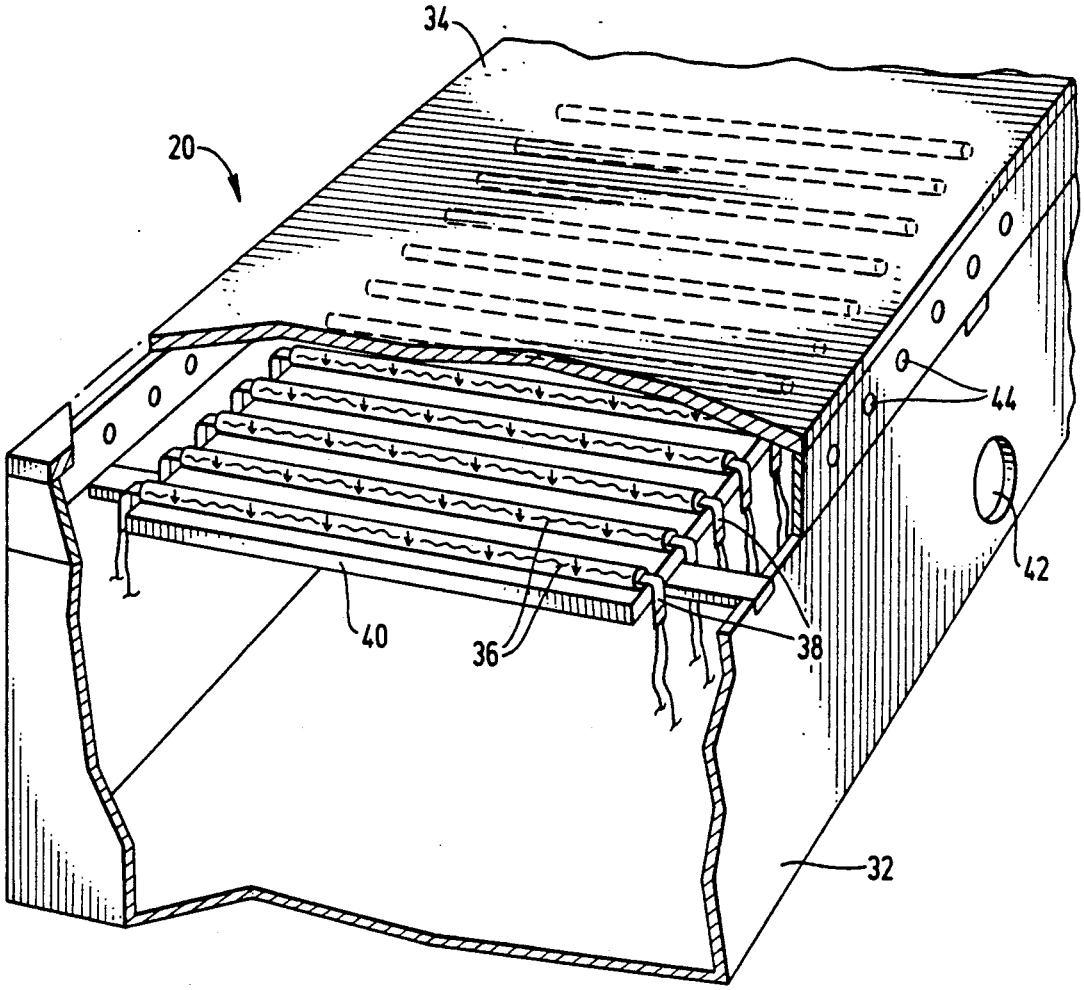
FIG. 2 is a perspective, partially cut-away view of an infrared sheet heating device which may be used in the present invention.

FIG. 2 shows a perspective cut-away view of an infrared sheet heating device 20. This heater 20 includes a housing 32 with a flat top surface that is preferably positioned adjacent the top side of the paper sheet 12 so that paper will not fall on the heat lamps 36 and ignite a fire. The top surface of the heater 20 typically comprises a plurality of quartz panes 34, or windows, that are heat resistant, substantially transparent to infrared energy and preferably removable for maintenance. (The sheet heating device 20 is here illustrated upsidedown with respect to the position of this same device in FIG. 1.)

A plurality of elongated infrared heating lamps 36 are located behind the quartz panes 34. The lamps 36 terminate in metal contact clips 38 which, in turn, are connected to a source of electrical energy for energizing the infrared lamps 36. For simplicity, the details of the electrical connections are not illustrated. However, in a presently preferred embodiment of the invention, the electrical connections are such that each infrared lamp 36 may be selectively energized with various amounts of electrical power independently of the other lamps 36. Cross-directional sectionalized control over sheet heating is thus provided. For example, if the cross-directional caliper profile of the paper sheet 12 is found to be uneven, the lamp or lamps 36 corresponding to a particular slice may be incrementally energized or deenergized to decrease or increase, respectively, the emitted energy, and therefore the caliper of that slice.

The infrared lamps 36 may be approximately 12 inches long and spaced apart in the cross-direction at one inch intervals. Panels 40 are suspended within the housing 32 and located immediately behind the infrared lamps 36, adjacent the side of the infrared lamps opposite the quartz panes 34. The panels 40 comprise a heat insulating material, with the panel surface adjacent the infrared lamps 36 having a reflective coating. The reflective coating serves to reflect and direct the infrared radiation from the lamps 36 through the quartz panes 34 onto the paper surface.

Due to the intense heat generated by the infrared lamps 36, the electrical contact clips 38 may become overheated. For this reason, cooling should be provided. Therefore, a side wall of the housing 32 is provided with an air entry port 42. Air enters the housing 32 through this port 42. The airflow into the housing 32 may be created by a blower motor and fan (not shown). A plurality of holes 44 are provided in the side walls of the housing 32 adjacent the infrared lamps 36. Preferably, the holes 44 are approximately ½ inch in diameter and are spaced apart at one inch intervals, one hole being provided in the sidewall of the housing 32 opposite each infrared lamp 36. The volume of airflow through the housing 32 may be adjusted to provide sufficient cooling.

Referring again to FIG. 1, the placement of the device 20 above the sheet 12, as shown, improves perfomance by efficiently exposing the sheet, upon its return around the fly roll "y", to any radiation originally transmitted through the sheet above. Alternatively, performance may be boosted by a reflective plate "z".

In a typical paper sheet supercalender, the infrared heating device 20 may provide a heat output of 15 kilowatts per foot in the cross-direction. Such a device, with a typical efficiency of about 45 percent may achieve a maximum sheet temperature rise of approximately 40° F. on supercalenders processing approximately ¾ ton of paper per hour per foot in the cross-direction.

Figure 3:
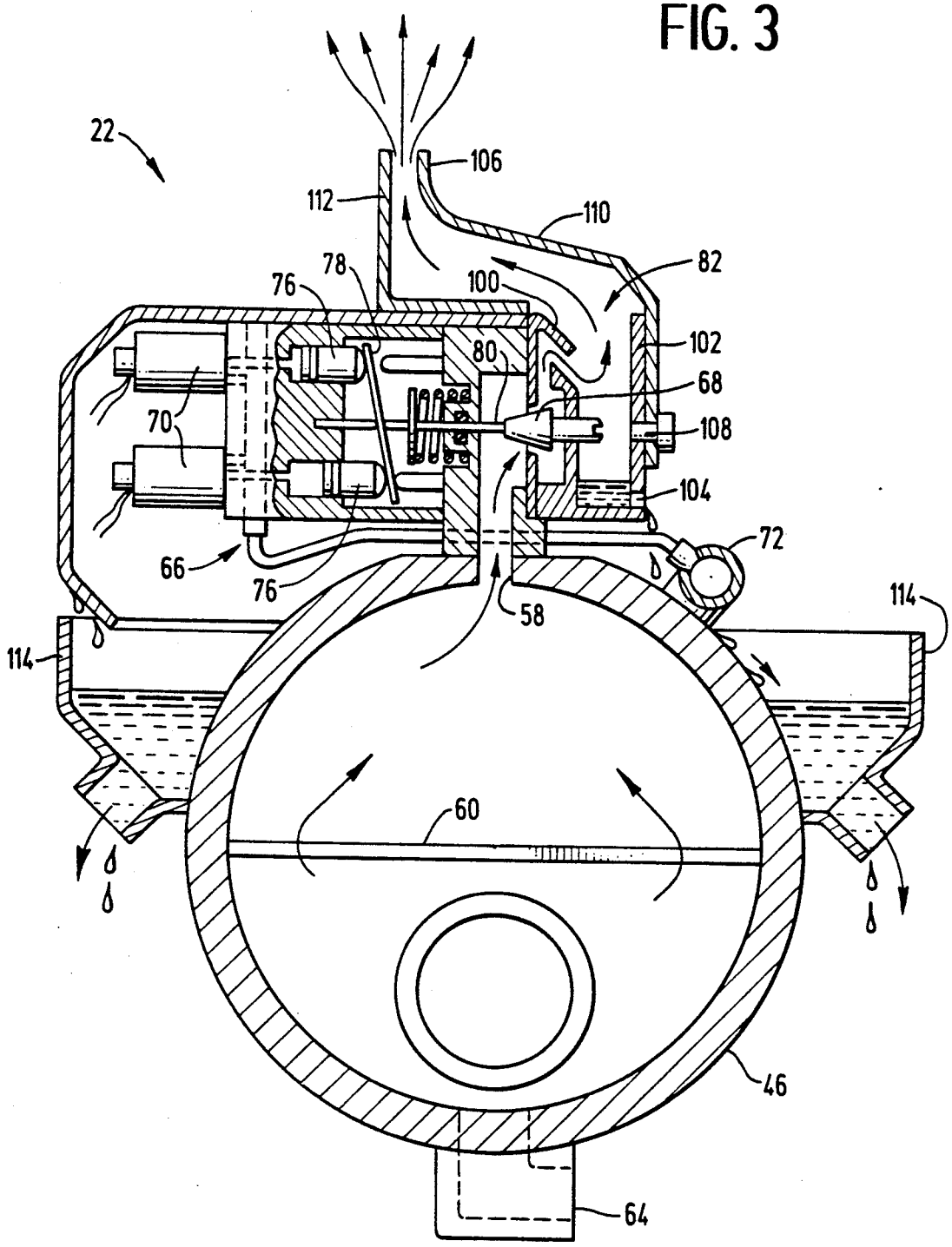
FIG. 3 is a cross-sectional view of a sheet moisturing device which may be used in the present invention.

The structure of a suitable mist device 22 is described with reference to FIGS. 3–4. FIG. 3 is a cross-sectional view of the device 22. In the illustrated embodiment, the mist device 22 comprises a steam manifold fabricated from a pipe 46 having a length generally spanning the width of the sheet of paper 12. Different paper producers manufacture paper sheet of differing widths, ranging generally from 10 to 36 feet. Accordingly, the length of the manifold pipe 46 will vary. The manifold pipe 46 is preferably made from corrosion resistant material such as, for example, stainless steel or aluminum. It has been determined that a six-inch inside diameter stainless steel pipe having a 3/16 inch wall offers adequate structural support.

Figure 4:
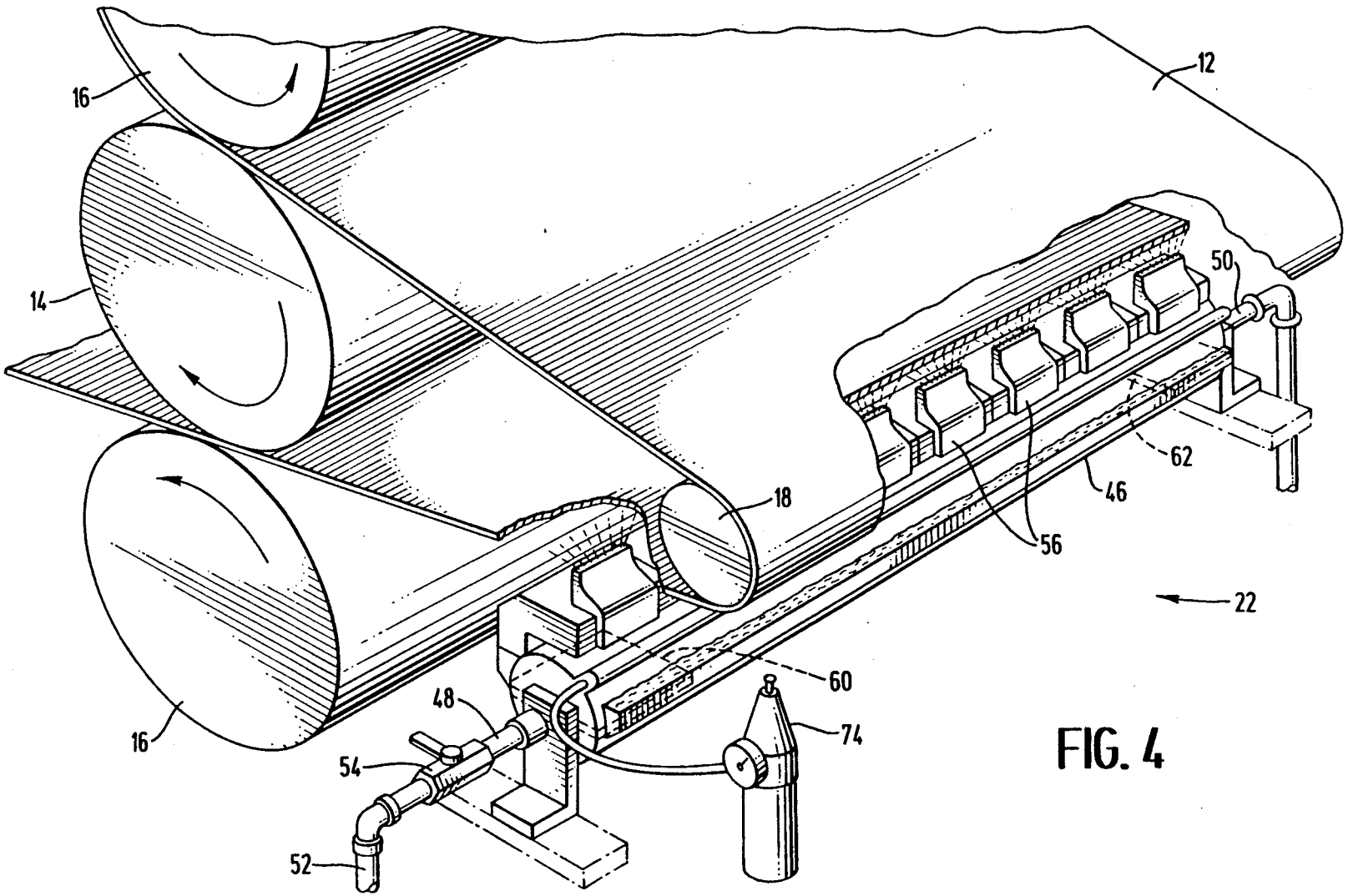
FIG. 4 is a perspective view of the device of FIG. 3.

As shown in FIG. 4, the steam manifold pipe 46 is provided with an inlet pipe 48 at one end and an outlet pipe 50 at its opposite end. Suitable inlet and outlet pipes have a diameter (for example, two inches) which is smaller than the diameter of the steam manifold pipe 46. Steam, preferably in a saturated state at 0–15 psig pressure, is delivered into the inlet pipe 48 by a main supply pipe 52. The inlet pipe 48 is provided with a pressure control valve 54 and a pressure sensor (not shown). Steam will enter the steam manifold pipe 46 only if the pressure control valve 54 is at least partially open. Therefore, in applications where two mist devices 22, 28 are provided, as shown in FIG. 1, each individual steam manifold pipe 46 may be supplied with steam independently of the other steam manifold pipe. Furthermore, the individual steam pressure valves 54 allow control over the volume of steam entering each steam manifold pipe 46. Thus, the amount of steam applied by each steam manifold pipe 46 can be regulated, thereby increasing the control over finish.

As shown in FIG. 4, a plurality of steam units 56 are mounted at intervals along the top of the steam manifold pipe 46. Each steam unit 56 is mounted over an orifice 58 (FIG. 3) having the shape of a slot provided in the top of the manifold pipe 46. Pressurized steam enters the steam units 56 from the pipe 46 through the slots 58. In the illustrated embodiment, each slot 58 is approximately 1.5 to 2 inches long and has a width of approximately ¼ inch to allow an adequate volume of steam to enter the steam units 56. The slots 58 are preferably distributed in even intervals along the entire length of the steam manifold pipe 46. Accordingly, the number of slots 58 and associated steam units 56 provided on a particular steam manifold pipe 46 depends upon the length of the pipe 46. Resolution of the control over the cross-directional finish profile is increased as the distance between the steam units 56 is decreased.

A baffle 60 is mounted inside the steam manifold pipe 46 adjacent the steam inlet pipe 48. The baffle 60 prevents condensate, potentially present in the steam, from entering the steam units 56 located near the steam inlet pipe 48. The baffle 60 spans the diameter of the pipe 46 and is preferably approximately 10 inches long. A second baffle 62 may be provided inside the pipe 46 adjacent its outlet pipe 50 and between the outlet pipe 50 and the steam units 56 to allow for reversed installation (i.e., steam flowing from the outlet pipe 50 to the manifold pipe 46). Condensate present in steam entering the steam manifold pipe 46 is deflected by the baffle 60 and collects at the bottom of the pipe 46, where it is drained out of the pipe 46 through at least one condensate drain 64 provided in the steam manifold pipe 46.

Each steam unit 56, as shown in FIG. 3, may include a 16-position digital steam valve 66, as disclosed in more detail in commonly assigned, U.S. Pat. No. 4,964,311 to Boissevain, entitled, Digitally Incremented Linear Actuator. This patent is incorporated herein by reference.

In general, the 16-position digital steam valve 66 disclosed comprises a poppet-type valve 68 controlled by four solenoid 70 actuated pneumatic pistons 76 (two of which are shown in FIG. 3) such as the HS-LS series solenoid valves commercially available from Numatics, Inc. (Michigan). Pressurized air is supplied to the solenoids 70 from air hose 72. The air hose 72 channels air from an air regulator 74 (FIG. 4) to the air inlet of each solenoid 70 at a pressure of approximately 40 psig for activation of the pistons 76 associated with the solenoids 70. Once a solenoid 70 is activated, air is admitted behind the associated piston 76 which is forced against a lever 78, and which in turn contacts the valve stem 80 of the poppet-style valve 68. The number and combination of actuated solenoids 70 determines the position of the valve steam 80 and thereby the position of the poppet valve 68. The position of the poppet valve 68, in turn, determines the amount of steam flowing upwards toward the paper sheet 12.

Figure 5:
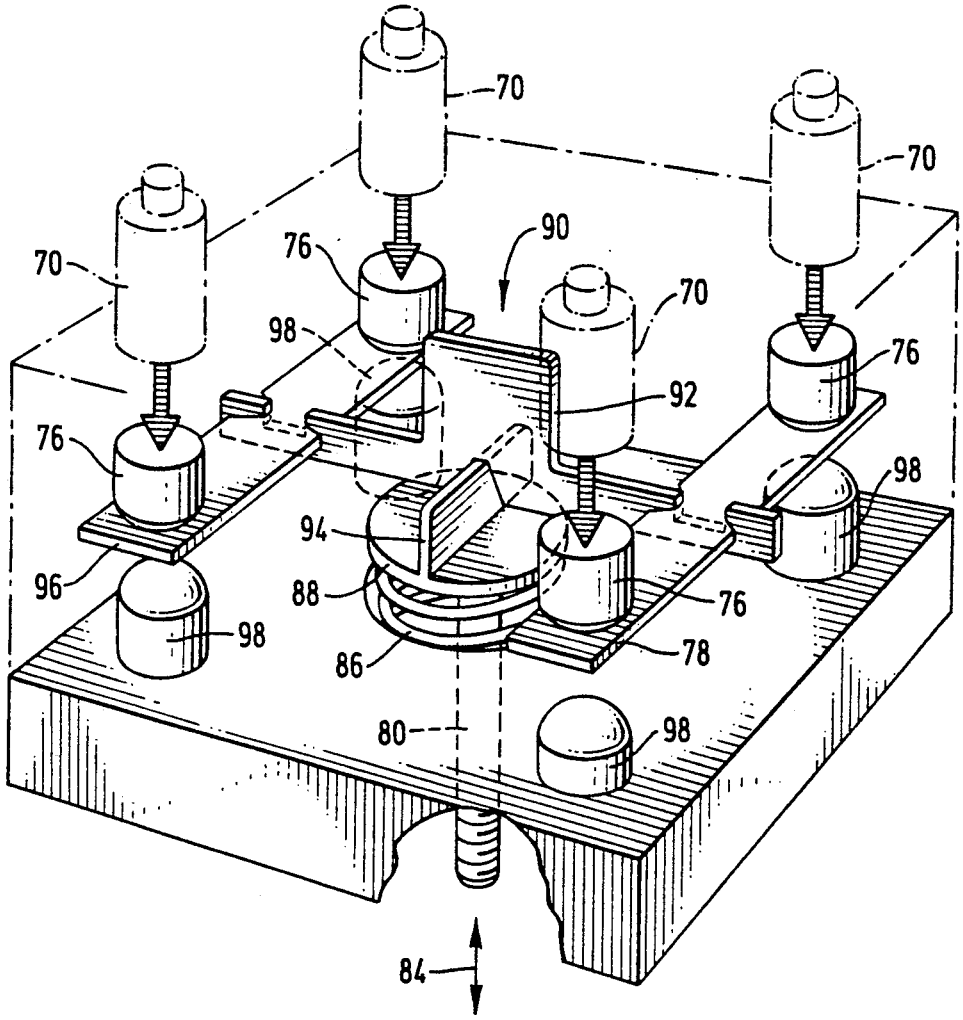
FIG. 5 is a perspective plan view of a portion of the digitally controlled steam valve illustrated in cross-section in FIG. 3.

FIG. 5 is a more detailed illustration of the control portion of the 16-position valve 66. One end of the linearly driven valve stem 80 is threaded to receive the poppet valve 68. The stem 80 is free to move in a linear direction indicated by arrow 84. A spring 86 biases the valve 68 closed by engaging a disk 88 mounted to the other end of the valve stem 80. Linear motion is imparted to the valve stem 80 by a movable H-shaped lever structure 90. As shown in FIG. 5, the pivotal coupling between the center lever 92 of the H-shaped structure and the valve stem 80 may be provided through a vertically extending plate 94 integrally mounted on the disk 88 along with a matching wedge-shaped opening in this center lever 92. With the center lever 92 resting freely on plate 94, this lever 92 is thus free to pivot through a small angular range.

The H-shaped lever structure further includes second and third levers 78 and 96, respectively, pivotally coupled to the center lever 92 at opposite ends thereof. The center lever 92, second lever 78 and third lever 96 thus form a generally "H"-shaped lever structure when viewed from above. The second lever 78 and third lever 96 are pivotally mounted on center lever 92 by resting them in matching notched recesses.

The H-shaped lever structure 90 is driven downward in the direction of linear travel by the previously mentioned pistons 76. As will be seen from FIG. 5, the four pistons 76 drive the lever structure 90 through four separate driving positions at the ends of the H-shaped structure. The positioning of the pistons 76 at the end of the H-shaped structure 90 causes the structure 90 to undergo various pivoting actions in addition to vertical translation upon actuation of various ones of the pistons 76.

The stroke of the individual pistons 76 associated with each driver 70 is preferably limited by a matching number of mechanical stops 98. To provided the 16 discrete linear positions for the valve stem 80, the stops 98 should be of differing heights to provide a varying stroke length for each piston 76. It will, therefore, be appreciated that selected activation of the solenoids 70 results in 16 distinct combinations of on/off activation positions of the pistons 76. This, in turn, will result in 16 distinct positions of the valve stem 80 and hence, by appropriate selection of the stroke lengths of the pistons 76, the 16 positions may be adjusted, if so desired, to provide equal linear activation steps for the valve stem 80.

In the presently illustrated embodiment of FIG. 3, the dimensions of the poppet valve 68 and bucket nozzle 82 are such that, when the poppet valve 68 is fully open, the nozzle 82 will expell approximately 15–25 pounds per hour of steam per foot of sheet in the cross-direction. Moreover, this low velocity or "lazy" steam exiting from the nozzle 82 should preferably have little or no velocity by the time it reaches the sheet. In fact, when such a low steam volume and velocity are used, the steam is preferably condensed to a fine mist of liquid water droplets by the time it contacts the sheet. During condensation, the steam gives up most of its heat to the surrounding atmosphere rather than to the sheet. Thus, unnecessary heating of the sheet, with its accompanying adverse affect n sheet caliper, is avoided.

Although the illustrated embodiment of the invention uses a 16-position digital valve, many types of commonly available automatically controllable valves may be utilized instead of the illustrated valve. In addition, liquid water ejected from an atomizer may be used instead of steam.

To convert the high velocity steam jetted from each valve 68 into low velocity, lazy steam, each valve 68 is provided with a bucket-shaped nozzle 82. The bucket nozzle 82 comprises a cane-shaped deflector plate 100, mounted adjacent the poppet valve 68, a container 102 (preferably having the shape of a bucket), provided with at least one drain hole 104 in its bottom, and a nozzle portion 106. For convenience, the bucket 102 of the bucket nozzle 82 is provided with a small orifice 108 to allow access to the poppet valve 68 for manual screwdriver adjustments. Pressurized steam entering the bucket nozzle 82 through the poppet valve 68 jets up against the deflector plate 100, which redirects the steam flow to the bottom of the bucket 102. Condensate present in the steam collects at the bottom of the bucket 102 and thus drains out of the drain hole 104. The steam, on the other hand, rises to the top of the bucket 102 and against a second, curved deflector 110 which, in conjunction with a third, off-set deflector 112, forms the nozzle portion of the bucket nozzle 82. The deflectors 100, 110, 112 cooperate to remove substantially all liquid from and decrease the velocity of the steam. This lazy steam is thus directed against the paper sheet 12 by the bucket nozzle 82 at a relatively low velocity, condenses in the air into a fine mist, and thus applies an extremely uniform amount of moisture to the sheet surface, without heating the sheet.

Condensate formed on the components of the mist device 22 is directed from the paper being calendered by a pair of gutters 114 provided on the steam manifold pipe 46. The gutters 114 are formed, one on each side, along the entire length of the steam manifold pipe 46.

As shown in FIG. 1, conventional finish 116 and caliper 118 sensors may be provided at a location downstream of the heating and moisturing devices 20, 22, 28. The finish sensor 116 and caliper sensor 118 monitor the surface finish and caliper of the paper sheet 12, respectively, and provide signals corresponding to the degree of surface finish and sheet caliper to controllers 120, 122, respectively. The controllers, illustrated schematically in FIG. 1 as separate units, may be, for example, portions of a single process control computer for the papermill, with an appropriate electro-mechanical interface for selectively actuating the valves 68 associated with each steam nozzle 82 and an appropriate controllable power supply for selectively varying power supplied to the infrared lamps 36.

Depending on the deviation of the measured sheet caliper at each slice from the predetermined desired caliper, the caliper controller 122 selectively controls the amount of electrical energy supplied to the corresponding infrared lamps 36 to thereby controllably heat the sheet. In many paper manufacturing situations, even when the infrared lamps 36 associated with a particular slice are fully energized, that slice may still have an insufficient finish at the point just before it reaches the mist devices 22, 28. Therefore, regardless of the amount of caliper correction required, the controllers 120, 122 in this situation can be programmed to treat finish and caliper independently. However, in the event that the heat application partially affects the desired sheet finish, or that moisture application partially affects the desired sheet caliper, then a predictive feed-forward control strategy may be used to coordinate the actions of the caliper and finish controllers, 122 and 120, to provide the optimum balance between finish enhancement and caliper maintenance. Such decoupling and optimizing strategies, which account for the affect of two different types of actuators on the same two sheet properties, are well known in the papermaking art (for example, those using matrix solutions).

In any event, as previously discussed, increases and decreases in finish can be obtained by appropriately programming the finish controller 120 to increase the amount of steam directed at the sheet 12 when the gloss or smoothness is substandard and to, conversely, decrease the steam when the gloss or smoothness is too great. In this way, the appropriate amounts of heat and moisture are provided to each slice.

The finish and caliper sensors 116, 118 may be of the known scanning type, in which the finish and caliper sensors 116, 118 are mounted to a carriage (not shown) which scans repeatedly back and forth across the width of the paper sheet 12 in the cross-direction. The finish sensor may, for example, be of the known type which directs a beam of light at the sheet surface and determines sheet finish based upon the intensity and diffusion of the reflected beam. The caliper sensor may be of the known sheet-contacting type in which abrasion resistant pads are pressed against opposite sides of the sheet. One pad is made of a conductive material and the other pad has a coil mounted to it. The inductance of the coil is affected by the distance between the pads and hence measurements of coil inductance are then related to sheet caliper. Of course, other types of sheet finish and caliper sensors may be used.

One embodiment of the present invention has been illustrated and described in detail above. However, it will be understood that various modifications may be made without departing from the spirit and scope of the invention. Accordingly, it is to be understood that the invention is not limited by the specific illustrated embodiments, but only by the scope of the appended claims and equivalents thereof.

I claim:

1. A system for calendering a sheet, comprising:

a calender stack, including a plurality of calendar rolls, wherein the calender stack has a plurality of nips formed between adjacent rolls of the calender stack, including a first nip where the sheet first enters the stack and a last nip where the sheet last exits the stack;

a heater for heating, with dry heat, the sheet being calendered by the calender stack, at a location substantially immediately before the sheet is pressed at the first nip of the calender stack; and a moisturizer disposed to apply a fluid to the sheet substantially immediately before the sheet is pressed at the last nip of the calender stack.

2. A system as in claim 1, further comprising:

a finish sensor disposed downstream of the calender stack, wherein the finish sensor is operable to generate finish signals indicative of the finish of the calendered sheet;

a caliper sensor disposed downstream of the calender stack, wherein the caliper sensor is operable to generate caliper signals indicative of the caliper of the calendered sheet; and at least one controller, operatively coupled to the finish sensor, the caliper sensor, the heater and the moisturizer, to receive the finish and caliper signals and to control the heater and moisturizer based upon the finish and caliper signals and predetermined finish and caliper values.

3. A system as in claim 2, wherein the heater includes multiple independently controllable heating elements spaced at intervals along the cross-direction of the stack, and wherein the moisturizer includes a plurality of nozzles and associated independently controllable valves disposed at intervals along the cross-direction of the stack, such that the heater and moisturizer are operable to direct controllable amounts of heat and fluid, respectively, toward selected cross-directional portions of the sheet.

4. A system as in claim 1, wherein the heater is an infrared heater.

5. A system as in claim 1, wherein the moisturizer is adapted to direct steam toward the sheet from a distance and at a velocity such that the steam condenses prior to contact with the sheet.

6. A system as in claim 1, wherein the calender stack is a supercalender.

7. A system as in claim 1, wherein the fluid includes a water mist.

8. A system as in claim 1, wherein the fluid includes steam.

9. A system as in claim 1, wherein the moisturizer is adapted to apply fluid to the sheet at substantially the same temperature as the sheet.

10. A method for calendering a sheet with a calender stack, including a plurality of calender rolls, wherein the calender stack has plurality of nips formed between adjacent rolls of the calender stack, including a first nip where the sheet first enters the stack and a last nip where the sheet lasts exits the stack, comprising the steps of:

controllably heating the sheet with dry heat at one location substantially immediately before the sheet enters the first nip of the calender stack; and controllable applying a fluid to the surface of the sheet at another location substantially immediately before the sheet enters the last nip of the calender stack.

11. The method of claim 10, further comprising the steps of:

measuring the sheet finish and sheet caliper; and controlling the amount of fluid applied to the sheet surface and the heating of the sheet based upon the measured finish and caliper, respectively, and predetermined finish and caliper valves.

12. The method of claim 10, wherein the fluid includes a water mist.

13. The method of claim 10, wherein the fluid includes steam.

14. The method of claim 10, wherein the calender stack is a supercalender.

15. A system for calendering a sheet, comprising:

a supercalender, including alternating adjacent hard and soft calender rolls, wherein the supercalender has a plurality of nips formed between adjacent rolls of the supercalender, including a first nip where the sheet first enters the supercalender and a last nip where the sheet last exits the supercalender;

heater means for heating the sheet with dry heat substantially immediately before the sheet is pressed at the first nip of the supercalender; and moisturizing means for moisturizing the sheet substantially immediately before the sheet is pressed at the last nip of the supercalender.

16. A system as in claim 15, further comprising:

sensor means for sensing the finish and caliper of the sheet after the sheet emerges from the supercalender; and controller means, operatively coupled to the heater means, moisturizing means and sensor means, for controlling the heater means and moisturizing means based upon the sensed caliper and finish, respectively.

17. A system as in claim 15, wherein the moisturizing means is disposed to direct steam at the sheet such that the steam condenses into a water mist prior to contact with the sheet and wherein, upon contact with the sheet, the water mist has substantially the same temperature as the sheet.

18. A system as in claim 15, wherein the moisturizing means does not substantially alter the sheet temperature.

19. A system for calendering a sheet, comprising:

a calender stack, including a plurality of calender rolls, wherein the calender stack has a plurality of nips formed between adjacent rolls of the calender stack, including a first nip where the sheet first enters the stack and a last nip where the sheet last exits the stack;

a heater for heating, with dry heat, the sheet being calendered by the calender stack, wherein the heater is disposed adjacent to the calender stack, at a location substantially immediately before the sheet is pressed at the first nip such that the sheet temperature is increased without an increase in sheet fluid content;

a moisturizer disposed to apply a fluid to the sheet substantially immediately before the sheet is pressed at the last nip and wherein the fluid is applied without a substantial change in sheet temperature;

a finish sensor disposed downstream of the calender stack, wherein the finish sensor is operable to generate finish signals indicative of the finish of the calendered sheet;

a caliper sensor disposed downstream of the calender stack, wherein the caliper sensor is operable to generate caliper signals indicative of the caliper of the calendered sheet; and at least one controller, operatively coupled to the finish sensor, the caliper sensor, the heater and the moisturizer, to receive the finish and caliper signals and to control the heater and moisturizer based upon the finish and caliper signals and predetermined finish and caliper values.

20. A system for calendering a sheet, comprising:

a calender stack including a plurality of calender rolls, wherein the calender stack has an upstream end and a downstream end and a plurality of nips formed between adjacent rolls of the calender stack;

a heater for heating, with dry heat, the sheet being calendered by the calender stack, wherein the heater is disposed adjacent to the calender stack at a location substantially immediately before the sheet is pressed at one nip of the calender stack such that the sheet temperature is increased without an increase in sheet fluid content;

a moisturizer disposed to apply a fluid to the sheet substantially immediately before the sheet is pressed at another nip of the calender stack different from the one nip, wherein the one nip is located upstream from the other nip, and without a substantial change in sheet temperature;

a finish sensor disposed downstream of the calender stack, wherein the finish sensor is operable to generate finish signals indicative of the finish of the calendered sheet;

a caliper sensor disposed downstream of the calender stack, wherein the caliper sensor is operable to generate caliper signals indicative of the caliper of the calendered sheet;

at least one controller, operatively coupled to the finish sensor, the caliper sensor, the heater and the moisturizer, to receive the finish and caliper signals and to control the heater and moisturizer based upon the finish and caliper signals and predetermined finish and caliper values; and wherein the heater includes multiple independently controllable heating elements spaced at intervals along the cross-direction of the stack, and wherein the moisturizer includes a plurality of nozzles and associated independently controllable valves disposed at intervals along the cross-direction of the stack, such that the heater and moisturizer are operable to direct controllable amounts of heat and fluid, respectively, toward selected cross-directional portions of the sheet.

21. A system for calendering a sheet, comprising:

a calender stack including a plurality of calender rolls, wherein the calender stack has a plurality of nips formed between adjacent rolls of the calender stack including a first nip where the sheet first enters the stack and a last nip where the sheet last exits the stack;

a heater for heating, with dry heat, the sheet being calendered by the calender stack, wherein the heater is disposed adjacent to the calender stack at a location substantially immediately before the sheet is pressed at the first nip of the calender stack such that the sheet temperature is increased without an increase in sheet fluid content;

a moisturizer disposed to apply a fluid to the sheet substantially immediately before the sheet is pressed at the last nip without a substantial change in sheet temperature;

a finish sensor disposed downstream of the calender stack, wherein the finish sensor is operable to generate finish signals indicative of the finish of the calendered sheet;

a caliper sensor disposed downstream of the calender stack, wherein the caliper sensor is operable to generate caliper signals indicative of the caliper of the calendered sheet;

at least one controller, operatively coupled to the finish sensor, the caliper sensor, the heater and the moisturizer, to receive the finish and caliper signals and to control the heater and moisturizer based upon the finish and caliper signals and predetermined finish and caliper values; and wherein the heater is disposed to heat the sheet substantially immediately before the sheet is pressed in an upper nip of the calender stack.

22. A system for calendering a sheet and decoupling caliper and finish of the sheet during calendering, comprising:

a supercalender including alternating adjacent hard and soft calender rolls, including a first nip where the sheet first enters the supercalender and a last nip where the sheet last exits the supercalender;

heater means for heating the sheet with dry heat substantially immediately before the sheet is pressed at the first nip of the supercalender;

moisturizing means for moisturizing the sheet substantially immediately before the sheet is pressed at the last nip of the supercalender downstream of the first nip;

sensor means for sensing the finish and caliper of the sheet after the sheet emerges from the supercalender; and controller means, operatively coupled to the heater means, moisturizing means and sensor means, for controlling the heater means and moisturizing means based upon the sensed caliper and finish, respectively.

23. A system for calendering a sheet, with a calender stack including a plurality of calender rolls, wherein the calender stack has an upstream end and a downstream end relative to the direction of sheet travel and a plurality of nips formed between adjacent rolls of the calender stack, comprising:

a heater for heating, with dry heat, the sheet being calendered by the calender stack, at a location substantially immediately before the sheet is pressed at one nip located closer to the upstream end than the downstream end of the calender stack; and a moisturizer disposed to apply a fluid to the sheet substantially immediately before the sheet is pressed at another nip located closer to the downstream end than the upstream end of the calender stack, wherein the moisturizer is disposed to direct the fluid at the sheet substantially immediately before the sheet is pressed at the last furthest downstream nip of the calender stack.

24. A method of assembling a system for calendering a sheet, including a calender stack having a plurality of calender rolls, wherein the stack has a plurality of nips formed between adjacent rolls, including a first nip where the sheet first enters the stack and a last nip where the sheet last exits the stack, comprising the steps of:

positioning a heater for heating the sheet, with dry heat, adjacent the sheet at a location substantially immediately before the sheet is pressed at the first nip of the calender stack; and positioning a moisturizer for applying moisture to the sheet, adjacent the sheet at a location substantially immediately before the sheet is pressed at the last nip of the calender stack.

* * * * *